US005239829A

United States Patent [19]

Blake

[11] Patent Number: 5,239,829

[45] Date of Patent: Aug. 31, 1993

[54] POWDER ACTIVATED TOOL WITH CRUSHER SLEEVE

[75] Inventor: Carroll F. Blake, Concord, N.H.

[73] Assignee: Burndy Corporation, Norwalk, Conn.

[21] Appl. No.: 882,991

[22] Filed: May 14, 1992

[51] Int. Cl.[5] ..... F01B 29/08

[52] U.S. Cl. ..... 60/638; 60/632; 227/10

[58] Field of Search ..... 60/632, 635, 636, 638; 227/9, 10

[56] References Cited

U.S. PATENT DOCUMENTS

| | | | |
|---|---|---|---|
| Re. 33,098 | 10/1989 | Center | 60/635 |
| 3,359,906 | 12/1967 | Herter | 102/95 |
| 3,516,246 | 6/1970 | Butler | 60/636 X |
| 3,590,740 | 7/1971 | Herter | 102/44 |
| 4,945,730 | 8/1990 | Laney | 60/635 |
| 5,005,485 | 4/1991 | Woo et al. | 102/531 |

*Primary Examiner*—Stephen F. Husar
*Attorney, Agent, or Firm*—Perman & Green

[57] ABSTRACT

An explosively operated tool includes a ram and an anvil. The ram is driven towards the anvil by ignition of a cartridge. A crusher sleeve is provided on the ram such that, in the event the ram is driven towards the anvil without a member or members therebetween, by an accidental discharge of the tool, the crusher sleeve can deform to thereby absorb kinetic energy from the ram and safely render the tool inoperative

12 Claims, 2 Drawing Sheets

POWDER ACTIVATED TOOL WITH CRUSHER SLEEVE

BACKGROUND OF THE INVENTION

1. Field of the Invention

The present invention relates to tools and, more particularly, to a crusher sleeve for use with a tool.

2. Prior Art

U.S. Pat. No. 4,722,189 and Re. 33,098 assigned to Burndy Corporation are directed to an explosively operated tool for connecting a tap or branch cable to a permanently installed main power cable. The connection between main cable and tap cable is established by means of a C-shaped sleeve joining the spaced tap and main cables and, by a wedge driven into the space between the cables within the C-shaped connector sleeve. Superior physical and electrical bonds are established by this method of connection.

The tool disclosed in the '189 patent drives a wedge into the C-shaped sleeve in the space between the main cable and the tap cable as the cable connection is established. The tool includes an anvil and power ram which engage the connector workpiece. The ram drives the connector wedge into final position. The tool uses an explosive powder charge which is ignited to generate sufficient force to drive the wedge into the sleeve between the main cable and the tap wire. As disclosed in U.S. Pat. No. 4,722,189, the tool and cartridge have interrelated designs and modes of operation for safe operation.

U.S. Pat. No. 4,945,730 to Laney describes a similar powder activated tool. The tool includes a crusher sleeve on the ram that is adapted to be deformed if the tool accidentally discharges without a connector between the ram and anvil. The crusher sleeve merely comprises an annular ring which has limited deformation characteristics and kinetic energy absorption characteristics.

It is an object of the present invention to provide a new and improved crusher sleeve for use with a explosively operated tool.

SUMMARY OF THE INVENTION

In accordance with one embodiment of the present invention an explosively actuated tool is provided comprising a frame and a breech action assembly. The breech action assembly is connected to the frame and includes a breech frame, a ram movably connected to the breech frame, and means for holding and igniting a charge in the breech frame to thereby drive the ram towards an anvil. The breech action assembly further comprises a crusher sleeve connected to the ram. The crusher sleeve comprises a tubular shaped member having a plurality of circumferential grooves and ribs. The sleeve is adapted to be deformed when the tool is accidentally discharged, without a connector and conductors between the anvil and ram, to thereby absorb the kinetic energy from the explosive charge and safely render the tool inoperative.

In accordance with another embodiment of the present invention, a ram assembly for use in an explosively actuated tool is provided. The ram assembly comprises a ram member and a crusher sleeve connected to the ram member. The crusher sleeve has a plurality of grooves therein and is adapted to deformably collapse in an accordion-like fashion on the ram member.

In accordance with another embodiment of the present invention, an explosively actuated tool crusher sleeve is provided. The sleeve is adapted to be connected to a ram of the tool and is deformable in the event of an accidental discharge of the tool. The sleeve comprises a general tubular shape with a plurality of annular grooves therein and a center channel adapted to receive a portion of the ram therein.

BRIEF DESCRIPTION OF THE DRAWINGS

The foregoing aspects and other features of the present invention are explained in the following description, taken in connection with the accompanying drawings, wherein.

DETAILED DESCRIPTION OF THE INVENTION

Figure 1:
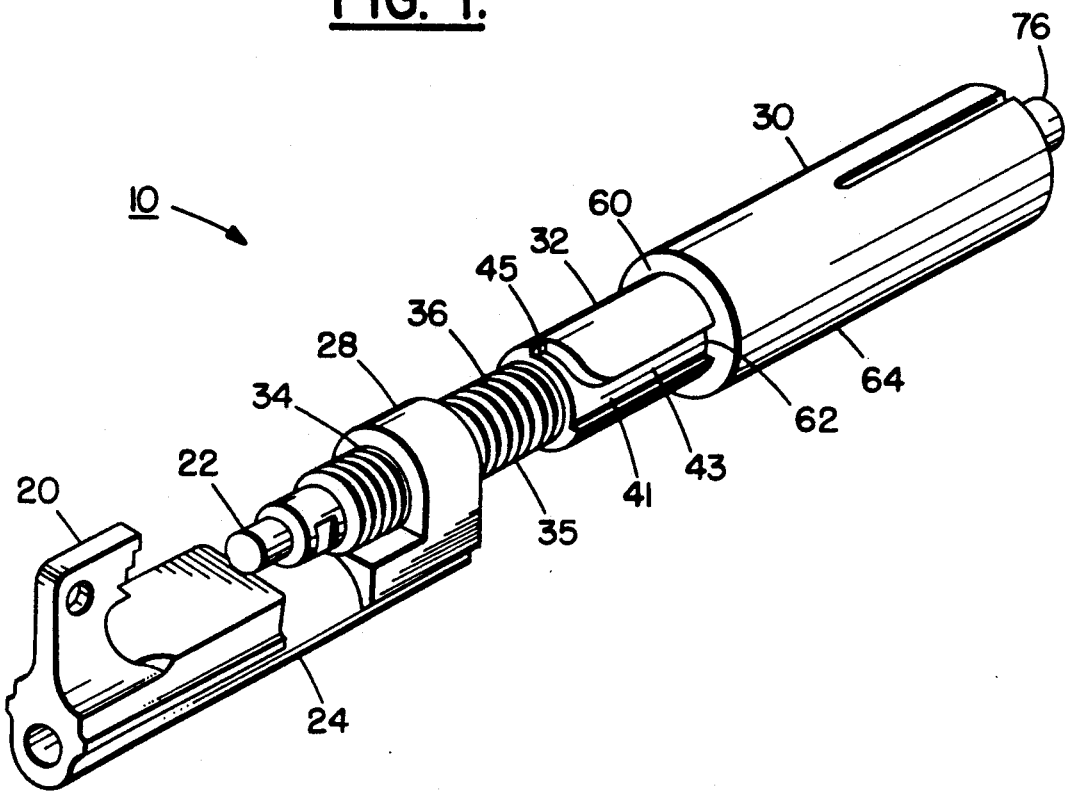
FIG. 1 is a perspective view of an explosively operated tool having features of the present invention.

Referring now to FIG. 1, there is shown a perspective view of an explosively operated tool 10 having features of the present invention. The tool 10, in the embodiment shown, is an explosively operated tool intended to be used for connecting a branch or tap wire to a main power line by means of a wedge connector and C-shaped sleeve. A similar tool is described in U.S. Pat. No. 4,722,189 which is hereby incorporated by reference in its entirety. Although the present invention will be described with reference to the single embodiment shown in the drawings, it should be understood that the present invention can be embodied in various different alternative forms and in combination with various different features. In addition, any suitable size, shape or type of elements or materials could be used.

Figure 2:
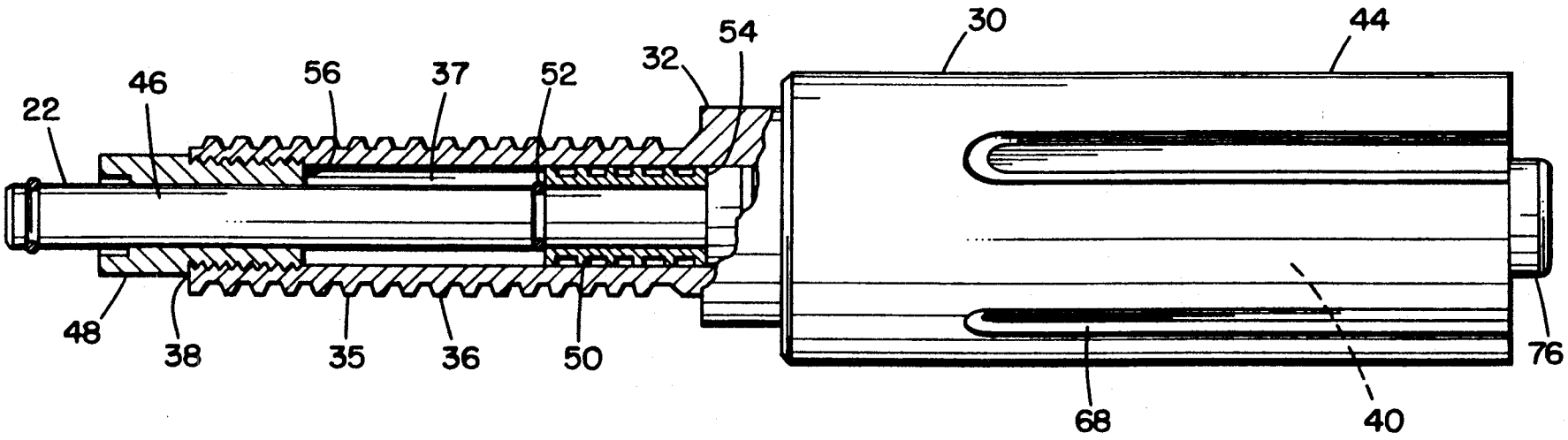
FIG. 2 is a partial cross sectional view of the breech action assembly of the tool shown in FIG. 1.

The power tool 10 includes an anvil 20 and a ram 22 which are adapted to engage a connector and a wedge in position with two cables such that the explosively powered ram can drive the wedge into its final position. The tool 10 further includes a base member or frame 24 for mounting the anvil 20 and a breech action assembly 30 connected thereto. The assembly 30 is fitted through a support sleeve 28 at an end of the frame 24 to position the power ram 22 along the longitudinal axis of the tool in general alignment with the anvil 20. The breech action assembly 30 shown also in FIG. 2 includes a main breech member 32 inserted into the support sleeve 28 for adjustment with respect to the anvil by means of a threaded connection 34 and for advancing the power ram and the anvil into engagement with a connector workpiece during the process of establishing the power line connection. The main breech member 32 is threaded at 35 along its forward surface 36 and includes a longitudinal axial bore 37 for receiving the power ram 22 through its muzzle end 38 and defining a firing chamber 40 for receiving a power booster cartridge (not shown) at its breech end 44. The main breech member 32 terminates in the breech action assembly 30 which accommodates the firing chamber lying along the longitudinal axis of the tool. The main breech member 32 is generally cylindrical and includes on its outer surface a slot 41 having longitudinally 43 and circumferentially 45 extending segments for receiving and guiding the breech action assembly 30.

The power ram 22 extends into the longitudinal bore 37 and into the firing chamber 40 for transmitting the explosive force to a connector workpiece. The ram has greater and lesser diameters with the lesser diameter forward portion 46 being slidably supported by an end bearing 48 securely threaded into the muzzle end 38 of the bore. A crusher sleeve 50 and lock ring 52 are fitted onto the ram adjacent to its interdiameter shoulder 54 for engagement with the confronting rear face 56 of the end bearing 48 when the power ram 22 is driven forward by the force of expanding gases from the ignited cartridge.

The breech action assembly 30 is slidably fitted over the main breech member 32 for loading, firing, and extracting booster cartridge cases in the firing chamber and for disarming the tool whenever it is removed from an unfinished workpiece without the power cell being detonated. The front face 60 includes an integral key 62 engaging the slot 41 for guiding the breech action assembly 30 through longitudinal and circumferential movements on the main breech member 32.

The breech action assembly 30 is generally cylindrical with a knurled outer surface 64, and a window or breech opening for inserting cartridges into the firing chamber 40. The breech action assembly 30 also includes a longitudinally extending slot 68 for receiving a safety latch on a pivot pin which cooperates with a hammer block to prevent movement of a hammer 76 until the cartridge case is in the firing chamber, the breech action assembly closed, and rotated to remove the hammer block.

Figure 3:
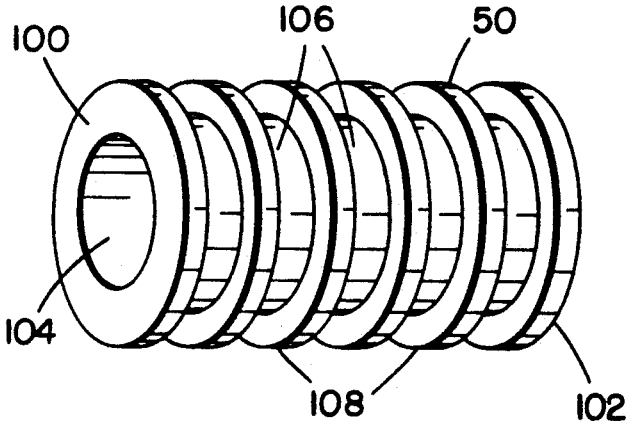
FIG. 3 is a perspective view of the crusher sleeve shown in the assembly of FIG. 2 prior to deformation.

Referring now also to FIG. 3, a perspective view of the crusher sleeve 50 is shown. The sleeve 50 is generally comprised of metal with a tube-like shape. However, any suitable type of material could be used. The sleeve 50 has a first end 100, a second end 102, a center channel 104, and an outer shape having a plurality of circumferential or annular grooves 106 and ribs 108. The crusher sleeve 50 is mounted on the ram 22 with a portion of the ram being located in the center channel 104. The second end 102 is positioned against the ram shoulder or ledge 54. The lock ring 52 is connected to the ram 22 adjacent the first end 100 of the sleeve 50 to thereby fixedly position the sleeve 50 on the ram 22 adjacent the shoulder 54. However, any suitable means could be provided to connect the sleeve 50 to the ram 22. In an alternate embodiment, the sleeve 50 might be fixedly located adjacent the end bearing rear surface 56 with the ram 22 being slidable in channel 104; at least until deformation of the sleeve 50 as further understood below. The outer surface of ribs 108 are in close proximity to the interior wall of the bore 37. The sleeve 50 is thus able to slide with the ram 22 in the bore 37 with minimal resistance to the such movement during normal operation of the tool 10.

Normal operation of the tool 10 is relatively simple. A booster cartridge is placed in the firing chamber 40 and the breech action assembly 30 is closed and locked in position by means of slot 41 and key 62. A connector sleeve, wedge and two cables are then located and positioned at the anvil 20. The breech action assembly 30 is then rotated by the operator relative to the frame 24. This causes the threads 35 and 34 of the main breech member 32 and the support sleeve 28 to move the breech action assembly 30 towards the anvil 20. The operator stops rotating the assembly 30 when the anvil 20 and front end of ram 22 sandwich the connector sleeve, conductors, and wedge therebetween. The operator then merely strikes the hammer 76 with a hand held tool. This causes a firing pin to ignite a primer of the booster cartridge to thereby fire the cartridge. Expanding gases from the cartridge act against the rear end of the ram 22 to thereby drive the ram 22 towards the anvil 20. The force exerted by the ram 22 is sufficient to drive the wedge into the connector sleeve with the cables therebetween in a very tight electrical and mechanical connection. Correspondingly, the force exerted by the connector sleeve, wedge and cables, by their connection, to the ram 22 causes the ram 22 to be stopped from moving forward when the connection is complete. The length of the sleeve 50, distance from the first end 100 to the end bearing rear end 56, and predetermined normal travel distance of the ram 22 from its rear position to a connection completion position are suitable selected such that the first end 100 of the sleeve 50 does not contact the end bearing rear end 56 during this normal operation of the tool. Once the connection is completed, the operator then merely unscrews the assembly 30, removes the completed connection, removes the spent booster cartridge, and resets the ram 22 back to its starting position. The tool 10 can now be used for another connection.

Figure 4:
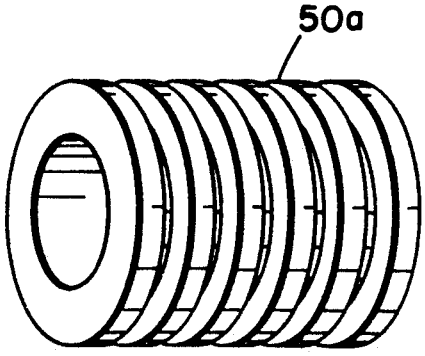
FIG. 4 is a perspective view of the crusher sleeve shown in FIG. 3 after the crusher sleeve has been deformed due to an accidental discharge of the tool shown in FIG. 1.

In the unlikely event the tool 10 accidentally discharges without a connector sleeve, conductor, and wedge between the ram and anvil, the tool 10 is adapted to safely disable itself. When such an accidental discharge occurs, the forward movement of the ram 22 is not stopped by a connector sleeve and wedge. However, the crusher sleeve 50 is adapted to bring the ram to a safe stop. Upon accidental discharge, the crusher sleeve 50 travels with the ram 22 and the sleeve's first end 100 contacts the end bearing rear end 56. The force of the ram's forward movement causes the crusher sleeve 50 to be deformed between the shoulder 54 and rear end 56. As can be seen in FIG. 4, the sleeve **50*a* is shown after an accidental discharge has occurred. Due to the unique configuration of the sleeve 50 with its grooves 106 and ribs 108, the sleeve 50 is adapted to longitudinally deform or collapse in an accordion-like fashion. This type of deformation provides a very good absorption of kinetic energy from the ram 22 into deformation of the sleeve 50. Thus, the ram 22 is stopped by the crusher sleeve 50 in a safe manner. In addition, when the sleeve 50 is deformed, it also expands slightly outward and inward to thereby lock the position of the ram relative to the main breech member 32 such that the tool 10** cannot be used again until it is repaired.

As the crusher sleeve 50 is crushed between the shoulder 54 and rear end 56, it deforms along its weakest longitudinal areas first; the grooves 106. Due to various material and manufacturing tolerances, the material at the grooves 106 does not deform all at the same time and to the same degree. Rather, the areas of deformation and timing of deformation may vary. However, the net effect is the same. As the crusher sleeve 50 is deformed, it increasingly resists movement of the ram 22 while minimizing effects of material plasticity to such resistance. This is done due to the fact that the material at the grooves 106 starts to deform before any substantial deformation of the material at the ribs 108 occurs. Hence, a crusher sleeve is provided more adapted to absorb the hard and fast impact of the ram 22 with minimal stress being applied to the end bearing 48.

Unlike uniform crusher sleeves in the prior art, such as disclosed in U.S. Pat. No. 4,945,730, the crusher sleeve of the present invention, due to its unique shape, is adapted to more safely absorb kinetic energy due to the accordion-like deformation. In addition, the tool 10 also disables the tool 10 from further use until it can be repaired. Although the embodiment shown in the drawings has uniform grooves 106 and ribs 108, it should be understood that any suitable type of shape or shapes could be provided in order to provide any suitable type of deformation characteristics.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An explosively actuated tool comprising a frame having an anvil;

a breech action assembly connected to the frame, the assembly having a breech frame, a ram movably connected to the breech frame, and means for holding and igniting a charge in the breech frame to thereby drive the ram towards the anvil, the breech action assembly further comprising a crusher sleeve connected to the ram, the crusher sleeve comprising a tubular shaped member having a plurality of circumferential grooves and ribs adapted to be deformed when the tool is accidentally discharged, without something between the anvil and ram, to thereby absorb kinetic energy from the ram and safely render the tool inoperative.

2. A tool as in claim 1 wherein the crusher sleeve is comprised of metal.

3. A tool as in claim 1 wherein the crusher sleeve is adapted to collapse in an accordion-like fashion.

4. A tool as in claim 1 wherein the crusher sleeve is adapted to deform between the ram and the breech frame and to lock the position of the ram relative to the breech frame.

5. A tool as in claim 1 wherein the breech action assembly is removably connected to the frame.

6. A ram assembly for use in an explosively actuated tool, the ram assembly comprising:

a ram member; and a crusher sleeve connected to the ram member, the crusher sleeve having a plurality of grooves therein and being adapted to deformably collapse in an accordion-like fashion on the ram member.

7. An assembly as in claim 6 wherein the grooves are located on the exterior circumference of the crusher sleeve.

8. An assembly as in claim 6 wherein the grooves are annular grooves.

9. An assembly as in claim 6 wherein the crusher sleeve comprises a plurality of crusher sleeve members.

10. An assembly as in claim 6 wherein the crusher sleeve is fixedly attached to the ram member.

11. An assembly as in claim 6 wherein the ram member has a ledge to support a rear end of the crusher sleeve.

12. An explosively actuated tool crusher sleeve adapted to be connected to a ram of the tool, the crusher sleeve being deformable in the event of an accidental discharge of the tool, the crusher sleeve comprising a general tubular shape with a plurality of annular grooves therein and a center channel adapted to receive a portion of the ram therein.

* * * * *